US007068249B2

(12) United States Patent
Kwon

(10) Patent No.: US 7,068,249 B2
(45) Date of Patent: Jun. 27, 2006

(54) METHOD OF DRIVING GATES OF LIQUID CRYSTAL DISPLAY

(75) Inventor: Oh-Kyong Kwon, Seoul (KR)

(73) Assignee: Samsung Electronics Co., Ltd. (KR)

( * ) Notice: Subject to any disclaimer, the term of this patent is extended or adjusted under 35 U.S.C. 154(b) by 96 days.

(21) Appl. No.: 09/946,684

(22) Filed: Sep. 6, 2001

(65) Prior Publication Data

US 2002/0044119 A1 Apr. 18, 2002

(30) Foreign Application Priority Data

Sep. 8, 2000 (KR) ..... 2000-53555

(51) Int. Cl.
*G09G 3/36* (2006.01)

(52) U.S. Cl. ..... 345/87; 345/100

(58) Field of Classification Search ..... 345/87, 345/90, 92, 99, 100
See application file for complete search history.

(56) References Cited

U.S. PATENT DOCUMENTS 6,175,351 B1 1/2001 Matsuura et al.
6,445,372 B1 * 9/2002 Asai ..... 345/99

FOREIGN PATENT DOCUMENTS

JP 7056143 3/1995

* cited by examiner

*Primary Examiner*—Jimmy H. Nguyen

(57) ABSTRACT

Disclosed is a method of driving a gate line in an LCD which enables to extend a line time by making different a falling time of scan signals while concurrently driving plural gate lines. In the method, scan signals which rise concurrently are applied to at least two gate lines while rendering said scan signals to fall at different timings such that said gate lines are concurrently driven and video signals are sampled by pixels corresponding to said gate lines at different falling times. The present invention makes it possible to extend a line time without lowering of the resolution or degradation of picture quality.

1 Claim, 6 Drawing Sheets

(N)th Frame

| | | | | | |
|---|---|---|---|---|---|
| − | + | − | + | − | + |
| − | + | − | + | − | + |
| + | − | + | − | + | − |
| + | − | + | − | + | − |

(N+1)th Frame

| | | | | | |
|---|---|---|---|---|---|
| + | − | + | − | + | − |
| + | − | + | − | + | − |
| − | + | − | + | − | + |
| − | + | − | + | − | + |

METHOD OF DRIVING GATES OF LIQUID CRYSTAL DISPLAY

BACKGROUND OF THE INVENTION

1. Field of the Invention

The present invention relates to a driving technology of a liquid crystal display (LCD), and more particularly, to a method of driving a gate line in a large sized and high resolution LCD which enables to extend a line time by making different a falling time of scan signals while concurrently driving plural gate lines.

2. Background of the Related Art

Generally, LCDs which are used for displaying characters, symbols, or graphics utilize the optical property of liquid crystal in which molecular arrangement of the liquid crystal is varied when an electric field is applied to the liquid crystal. The LCD is one kind of flat panel displays in which the liquid crystal technologies are combined with the semiconductor technologies.

Thin film transistor (TFT) LCDs have thin film transistors as the switching element for turning on and off pixels. As the TFTs are turned on or off, the pixels are turned on or off.

As shown in FIG. 1, a general TFT LCD includes a plurality of cells arranged in a matrix configuration. A unit cell includes a TFT 132 serving as the switching element, a liquid crystal cell 134 and a storage capacitor $C_{STG}$. Sources of the TFTs are connected to data lines (D1–DN) arranged in a column direction and one sided ends of the data lines are connected to a source driver 120. Gates of the TFTs are connected to gate lines (G1–GM) arranged in a row direction and one sided ends of the gate lines are connected to a gate driver 110, thereby realizing a display having an N×M resolution. For instance, SVGA level has a resolution of 800×600, XGA level has a resolution of 1024×768 and UXGA level has a resolution of 1,600×1200.

Here, the source driver 120 is also referred to as a data driver or column driver and the gate driver is referred to as a scan driver or row driver.

Referring to FIG. 1, the liquid crystal cell 134 is connected between drain of the TFT 132 and pixel electrode and is disposed between the pixel electrode and a common electrode of an upper panel. The pixel electrode is made of transparent indium tin oxide (ITO) having the conductivity. When a turn on signal is applied to gate of the TFT 132, the pixel electrode transfers a signal voltage applied through the source driver 120 to the liquid crystal cell 134. The common electrode is also made of ITO and applies a common voltage Vcom to the liquid crystal cell. The storage capacitor $C_{STG}$ maintains a voltage applied to the pixel electrode during a constant time and controls light transmittance by varying an orientation state of liquid crystal molecules in the liquid crystal cell. One end of the storage $C_{STG}$ can be connected to an independent electrode or gate electrode, which is called "storage on gate" mode.

In a driving of this pixel array, when a driving voltage is applied to the liquid crystal only in one direction, degradation of the liquid crystal is accelerated. To this end, there is used an inversion which periodically applies an image data voltage applied to the liquid crystal in an opposite polarity. The period of such an inversion is normally one filed.

There are four inversion driving methods, i.e., a field inversion driving method which changes the voltage polarity of all pixels every field at once, a line inversion driving method which changes the voltage polarity every a line connected to a single scan line, a column inversion driving method which changes the voltage polarity of a column every field and a dot inversion which changes the polarity by unit of a pixel. In any cases, the voltage, which is applied to the pixel electrode through the drain electrode of the TFT is alternatively changed such that it has a positive (+) or negative (−) direction with respect to the common voltage Vcom.

FIG. 2 is a schematic view showing a general gate driver. Referring to FIG. 2, a gate driver 110 includes a shift register 111, a level shifter 112 and an output buffer 113. The shift register 111 receives a vertical synchronous signal and a vertical clock signal, to thereby generate scan pulses sequentially. The level shifter 112 shifts a voltage level of the scan pulses to approximately 30 V. The output buffer 113 provides respective gate lines of G1–GM with the level-shifted scan pulses.

Here, The most general driving method that is used to drive gates is the progressive scanning method as shown in FIG. 3. Since the progressive scanning method scans only a single gate line (or scan line) during one line time (1H), respective gate driving signals are sequentially applied to gate lines every 1H.

On the other hand, as LCDs are developed with a trend of a large screen size, resistance of data lines and load of capacitance increase and thus a time which the data driving circuit transmits a video signal to the pixel is more and more shortened. This causes an insufficient charge of the pixel and affects on a lowering in the picture quality. Therefore, this problem should be necessarily resolved.

FIG. 4 shows driving signals used in the conventional interlace scanning method in order to increase the line time. Referring to FIG. 4, the conventional interlace scanning method has a line time longer than the progressive scanning method two times.

However, this interlace scanning method has a drawback in that the vertical resolution decreases by half since the same video signal is transmitted into pixels connected to two gate lines. Accordingly, these conventional gate driving methods are not alternative methods upon considering a high picture resolution -oriented current trend.

SUMMARY OF THE INVENTION

Accordingly, the present invention is directed to a method for driving gates of an LCD that substantially obviates one or more problems due to limitations and disadvantages of the related art.

An object of the present invention is to provide a method for driving gates of an LCD enabling to extend the line time without lowering the resolution by rendering a falling time of scan signals different while driving plural gate lines at the same time.

To accomplish the above object and advantages, there is provided a method for driving gates of an LCD in which scan signals which rise concurrently are applied to at least two gate lines while rendering said scan signals to fall at different timings such that said gate lines are concurrently driven and video signals are sampled by pixels corresponding to said gate lines at different falling times.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiment of the present invention, examples of which are illustrated in the accompanying drawings.

Figure 1:
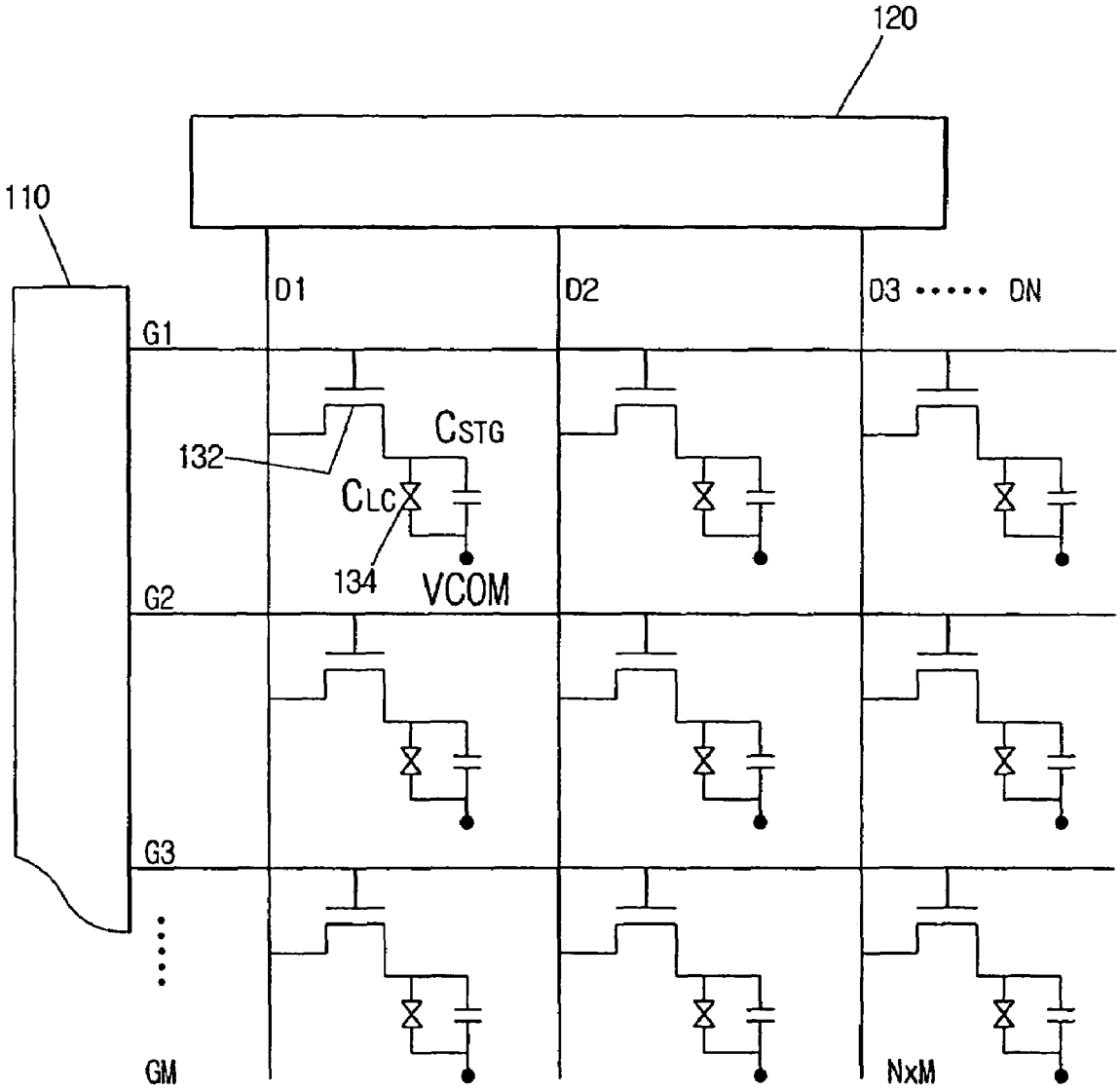
Fig.1 (Prior Art)
FIG. 1 is an equivalent circuit diagram of a general TFT-LCD.
Figure 2:
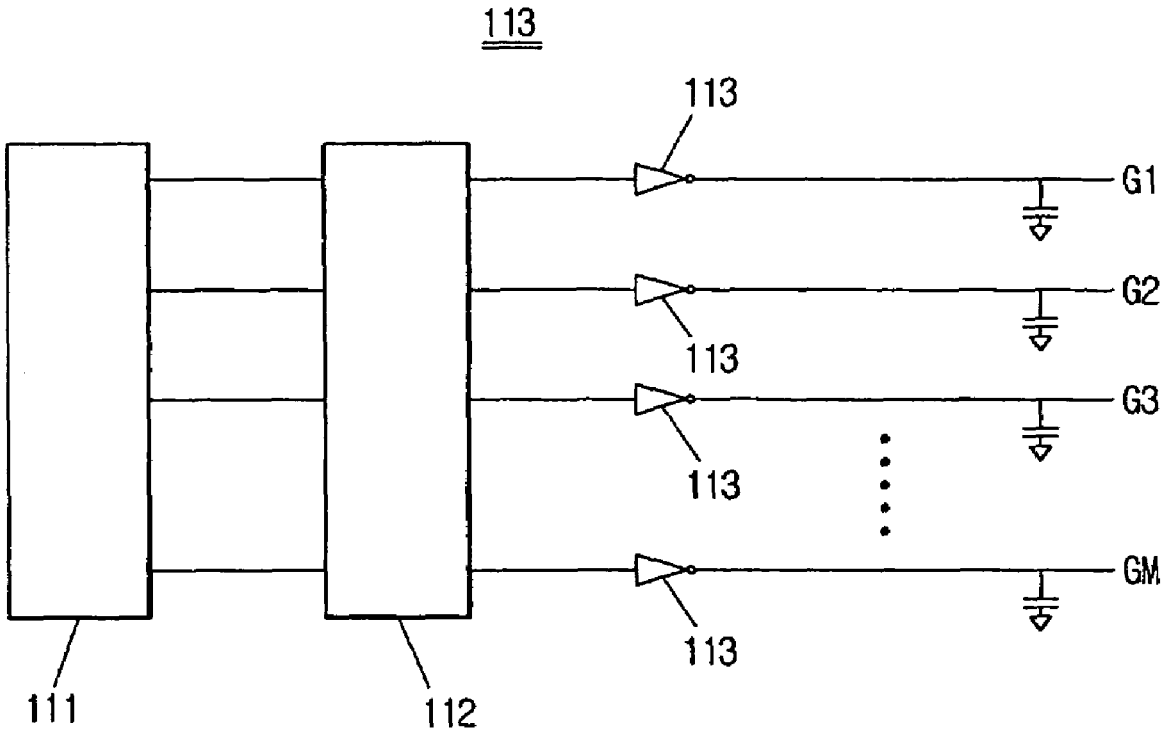
Fig.2 (Prior Art)
FIG. 2 is a schematic view of a general gate driving circuit.
Figure 3:
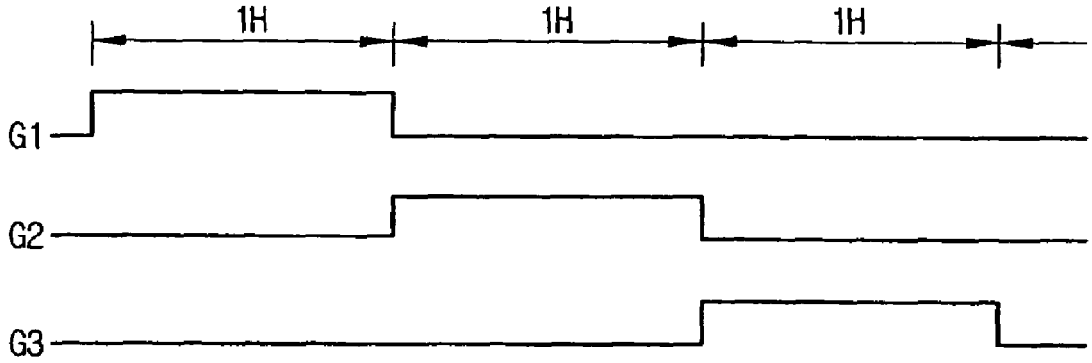
Fig.3 (Prior Art)
FIG. 3 is waveforms of gate driving signals of a general progressive scanning method.
Figure 4:
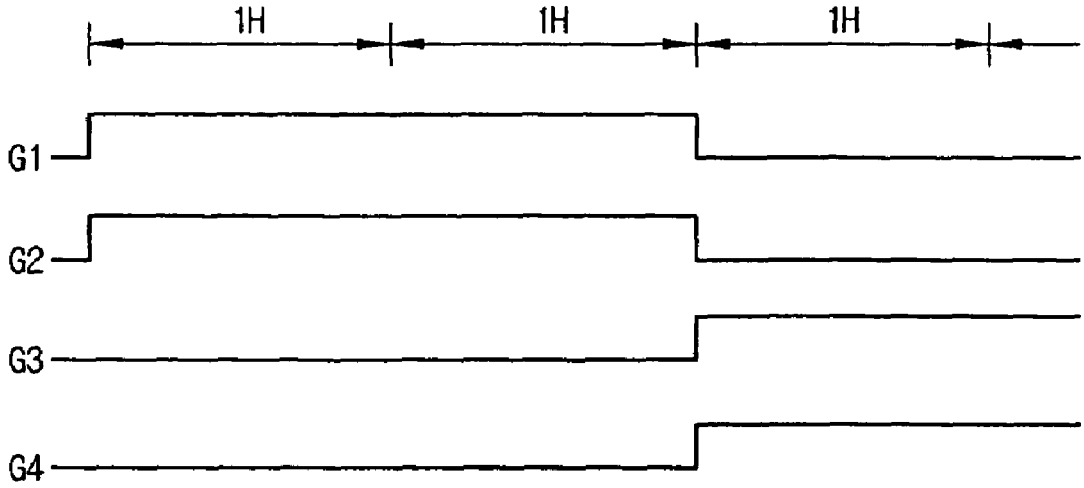
Fig.4 (Prior Art)
FIG. 4 is waveforms of gate driving signals of an interlace scanning method so as to increase the line time.
Figure 5:
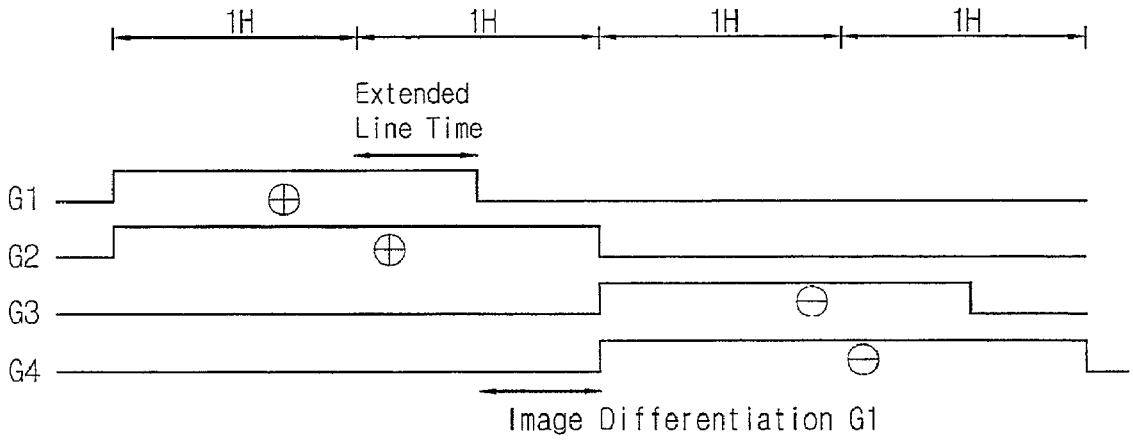
FIG. 5 is waveforms of gate driving signals of a line time extending driving method to scan two gate lines concurrently in accordance with the present invention.

FIG. 5 is waveforms of gate driving signals in a line time extending driving method to scan two gate lines concurrently in accordance with the present invention.

Referring to FIG. 5, a driving method of the present invention is characterized in that gate driving signals applied to two gate lines rise concurrently and fall at different timings. According to the conventional two gate line driving method, if gate driving signals are concurrently applied to gate lines G1 and G2, identical image signal is applied to pixels sharing the same data line. On the other hand, according to the gate line driving method of the present invention, since the first gate driving signal G1 falls first, an image signal corresponding to pixels connected to the first gate line is sampled. After that, the second gate driving signal G2 falls and thereby an image signal corresponding to pixels connected to the second gate line is sampled.

Thus, according to the gate driving method of the present invention, it becomes possible to extend the line time 30–70% longer than that in the normal progressive scanning method and at the same time it becomes possible to transmit image signals corresponding to pixels connected to each of the gate lines unlike the conventional interlace scanning method in which two gate lines are concurrently driven and they concurrently fall. Here, a specific extending percentage of the line time may be different depending on a panel characteristic.

For example, when driving gate lines of an LCD panel having a resolution of XGA level (1024×768) using a frame frequency of 75 Hz, the conventional progressive scanning method secures a line time of approximately 17 μsec but a line time extending driving method of the present invention can secure a line time of approximately 22–30 μsec.

The line time extending driving method of the present invention is executed by concurrently driving N number of gate lines. For instance, FIG. 5 corresponds to a method of concurrently selecting two gate lines, FIG. 6 corresponds to a method of concurrently selecting three gate lines and FIG. 7 corresponds to a method of concurrently selecting four gate lines.

Figure 6:
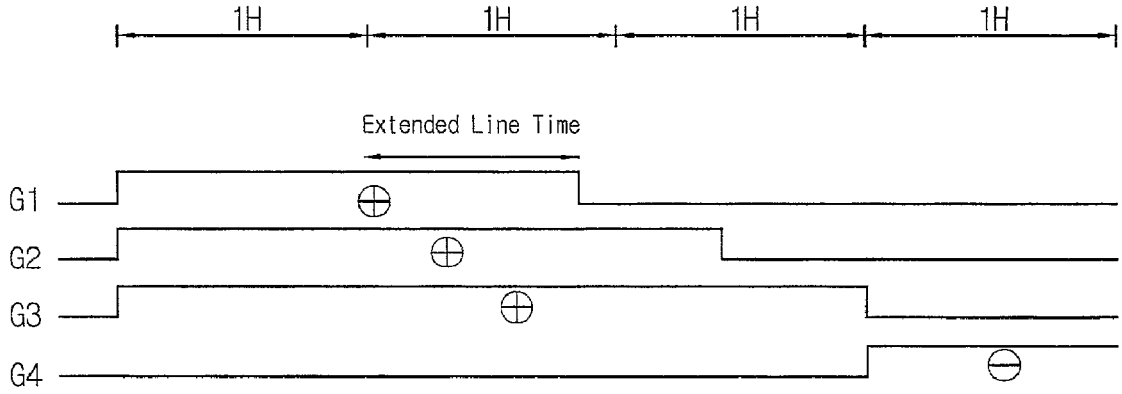
FIG. 6 is waveforms of gate driving signals of a line time extending driving method to scan three gate lines concurrently in accordance with the present invention.
Figures 7, 8:
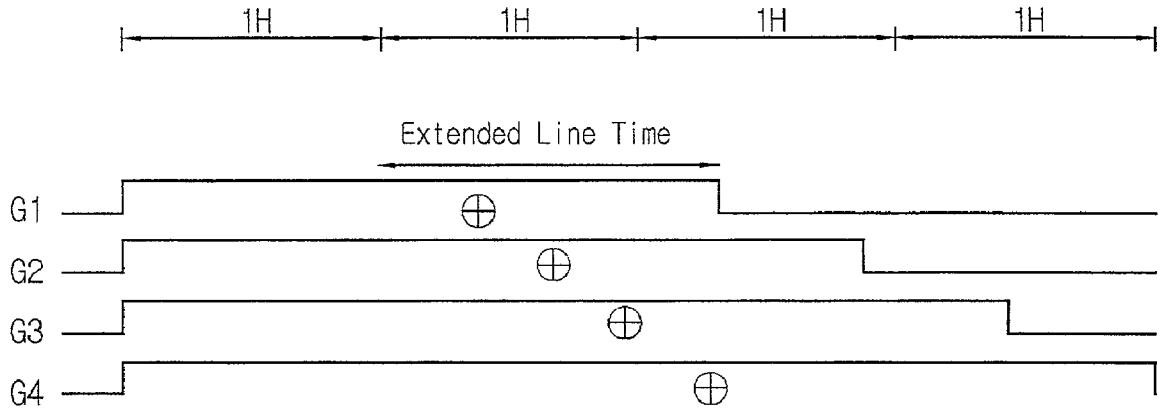
FIG. 7 is waveforms of gate driving signals of a line time extending driving method to scan four gate lines concurrently in accordance with the present invention.
FIG. 8 is a table showing a line polarity of N-th and (N+1)-th when inversion-driving two gate lines in accordance with the present invention.

Thus, as the number of lines which can be concurrently selected and then driven increases, it is possible to secure more longer line time and to extend the number of selectable lines. And, as shown in FIGS. 5, 6 and 7, the line time extending driving method of the present invention performs an N-line inversion driving in which image signals having the same polarity are transferred to pixels connected gate lines which are concurrently selected. In other words, as shown in FIG. 8 of describing one example of two lines inversion driving, such an inversion is performed every line in the column direction and is performed every two lines in the row direction. And, when driving N number of lines concurrently, such an inversion is performed every N lines.

In the meanwhile, according to the gate line driving method of the present invention in which the falling timings of two gate lines are different from each other while the two gate lines are concurrently driven, it is possible to anticipate an extension of the line time but there may be occur a voltage difference of ΔVp between pixels in even gate line and odd gate line. This voltage difference is due to the following reason.

Figure 9:
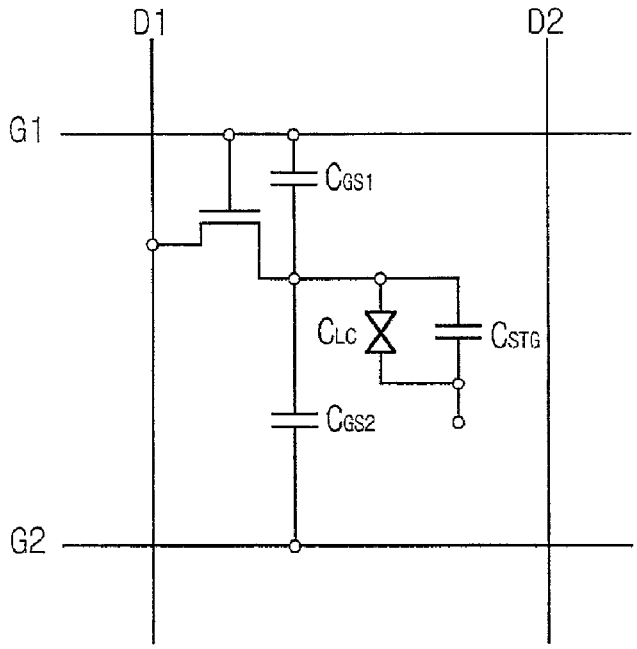
FIG. 9 is a general circuit diagram of a TFT-LCD pixel in accordance with the present invention.

Pixels of a TFT-LCD can be modeled in a circuit diagram of FIG. 9. In FIG. 9, symbols D1 and D2 are data lines, G1 and G2 are gate lines, $C_{LC}$ is liquid a crystal cell modeled in a capacitor and $C_{STG}$ is a storage capacitance, respectively. And, symbols $C_{GS1}$ and $C_{GS2}$ indicate parasitic capacitances.

Referring to FIG. 9, as a gate driving signal of G1 falls, a voltage of the liquid crystal cell $C_{LC}$ is coupled with the parasitic capacitance $C_{GS1}$ and thereby the voltage is varied. A variation amount in this voltage corresponds to the ΔVp and can be obtained from the following equation 1.

$$\Delta V_{P1} = \frac{C_{GS1}}{C_{LC} + C_{STG} + C_{GS1} + C_{GS2}} \times (-V_G) \qquad \text{Eq. 1}$$

where, $C_{LC}$ is a capacitance of the liquid crystal and $V_G$ is a magnitude in the gate driving signal.

This voltage variation amount ΔVp is also generated by the parasitic capacitance $C_{GS2}$. In other words, as a gate signal of G2 rises, a voltage of the liquid crystal is coupled with the parasitic capacitance $C_{GS2}$ and thereby the voltage is varied.

As shown in FIG. 9, the pixels connected to an odd gate line generate only a voltage variation amount of ΔVp1defined by the equation 1 while the pixels connected to an even gate line generate a voltage variation amount corresponding to a sum of ΔVp1 and ΔVp2 which is being defined by the below equation 2.

$$\Delta V_{P2} = \frac{C_{GS1}}{C_{LC} + C_{STG} + C_{GS1} + C_{GS2}}(-V_G) + \frac{C_{GS2}}{C_{LC} + C_{STG} + C_{GS1} + C_{GS2}} V_G \quad \text{Eq. 2}$$

Thus, the pixels connected to the odd gate lines have different voltage variation amount than the pixels connected to the even gate lines. This is because when the image signal is sampled to the pixels connected to the gate line of G1, only a gate driving signal applied to the gate line of G1 falls while when the image signal is sampled to the pixels connected to the gate line of G2, falling of a gate driving signal applied to the gate line of G2 and rising of a gate driving signal applied to the gate line of G3 are concurrently generated. As a result, the voltage difference ΔVp between even gate lines and odd gate lines is generated and thereby the picture quality may be lowered.

Figure 10:
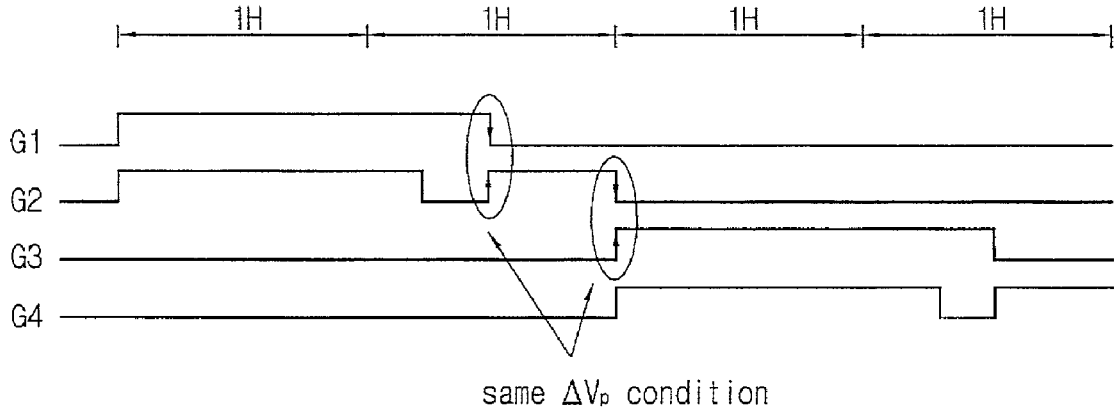
FIG. 10 is waveforms of gate driving signals of a line time extending driving method to scan improved two gate lines concurrently in accordance with the present invention.

In order to resolve the aforementioned drawbacks, as shown in FIG. 10, another embodiment of the present invention partially modifies the gate driving method of the present invention provided previously. In other words, as aforementioned, since the voltage difference ΔVp between pixels connected to even gate lines and odd gate lines is due to a difference between the gate driving signals applied to the even gate lines and the odd gate lines, the present embodiment renders the odd gate lines and the even gate lines to be under the same driving condition.

For instance, when driving two gate lines as shown in FIG. 10, gate driving signals which are being applied to even gate lines of G2, G4 and so on to fall right before gate driving signals which are being applied to odd gate lines of G1, G3 and so on fall and the gate driving signals which are being applied to even gate lines of G2, G4 and so on again rise when the gate driving signals which are being applied to odd gate lines of G1, G3 and so on fall. As a result, all of the pixels connected to the even and odd gate lines have identical condition for generation of the voltage difference ΔVp and thus the voltage difference problem between the pixels connected to the even and odd gate lines can be resolved.

While the driving method of the present invention shows and describes embodiments in which the gate driving signals applied to the gate lines rise concurrently and fall at different timings, it is not limited to the above-described embodiments. In other words, the present invention makes it possible to extend a line time without lowering of the resolution by allowing the gate driving signals to fall concurrently and then to rise at different timings depending on characteristics of the used LCD panel, thus driving plural gate lines concurrently while transferring video signals to the gate lines at different rising timings.

As described above, according to a gate line driving method of the present invention, it becomes possible to increase a line time without lowering of the resolution and sufficiently charge/discharge the pixel electrode by making different a falling time of scan signals while concurrently driving plural gate lines.

Further, the gate driving signal applied to the odd gate line has the same falling condition as the gate signal applied to the even gate line, thereby preventing degradation in picture quality.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method for driving gate lines of a liquid crystal display, comprising: applying scan signals which rise concurrently to at least two gate lines while rendering said scan signals to fall at different timings during N line drive times such that said gate lines are concurrently driven and video signals to be provided to each of the at least two gate lines are sampled by pixels corresponding gate lines at different falling times, wherein each scan signal rises concurrently and has a different falling time on each gate line during N line drive times when driving N gate lines concurrently, wherein N is an integer no less than 2, the falling time of an Nth scan signal is the end of an Nth line drive time, and the falling time of a kth scan signal is sooner than the falling time of a (k+1)th scan signal, wherein k is an integer no less than 1 and no more than (N−1), such that video signals to be provided for each corresponding gate line are sampled by pixels of said corresponding gate line at different falling timings during said N line times, wherein said scan signals comprise a first scan signal which is applied to an even gate line and a second scan signal which is applied to an odd gate line, wherein the first scan signal falls faster than the second scan signal and then independently rises when the second scan signal falls, to render a falling condition of the odd gate line and the even gate line equal.

* * * * *